United States Patent [19]

Combeau

[11] 4,411,191

[45] Oct. 25, 1983

[54] CENTRALLY MECHANICALLY CONTROLLED PRINTING MACHINE

[75] Inventor: Guy Combeau, Aixe-sur-Vienne, France

[73] Assignee: Societe d'Exploitation des Machines Dubuit, Paris, France

[21] Appl. No.: 285,762

[22] Filed: Jul. 22, 1981

[30] Foreign Application Priority Data

Jul. 29, 1980 [FR] France ..... 80 16651

[51] Int. Cl.[3] ..... B41F 17/22

[52] U.S. Cl. ..... 101/38 A; 101/126

[58] Field of Search ..... 101/38 R, 38 A, 39, 101/40, 35, 126, 115; 264/80

[56] References Cited

U.S. PATENT DOCUMENTS

| | | | |
|---|---|---|---|
| 2,624,274 | 1/1953 | Harvey | 101/38 A |
| 2,625,098 | 1/1953 | Robbins et al. | 101/38 A |
| 2,721,516 | 10/1955 | Campbell et al. | 101/126 X |
| 2,746,084 | 5/1956 | Kreidl | 264/80 X |
| 2,802,412 | 8/1957 | Lecluyse et al. | 264/80 X |
| 3,933,091 | 1/1976 | Von Saspe | 101/40 |
| 4,091,726 | 5/1978 | Walker | 101/126 X |

*Primary Examiner*—Clifford D. Crowder
*Attorney, Agent, or Firm*—Charles A. Brown

[57] ABSTRACT

A centrally mechanically controlled printing machine is disclosed comprising a conveyor equipped with spaced-apart article carriers for accommodating articles to be printed, a plurality of work stations comprising a singeing station, a prepositioning station, a printing station and a drying station disposed along the conveyor, each of the work stations being equipped with a mandrel transfer unit for selectively picking up an article from a said article carrier and dropping it off. A single cam controlling the operation of the mandrel transfer units of at least two of the work stations synchronously with the advance of the conveyor, a cam follower cooperable with the single cam, an arm fixed for rotation with a central control shaft common to the at least two work stations and carrying the cam follower, and an actuating lever for controlling each of the mandrel transfer units being fixed for rotation with the central control shaft.

12 Claims, 3 Drawing Figures

CENTRALLY MECHANICALLY CONTROLLED PRINTING MACHINE

The present invention relates in general to printing machine and, more particularly though not exclusively, to screen printing machines.

Printing machines are known comprising a conveyor, for example an intermittent advance conveyor, equipped with spaced apart article carriers adapted to accommodate articles to be printed in the machine. In addition such printing machines comprise a plurality of work stations spaced longitudinally along the conveyor, such as a flame treatment station, a prepositioning station, a printing station and a driving station. Also in such printing machines each of the work stations is equipped with article transfer units including a mandrel adapted to pick up an article on an article carrier and drop it off.

Such is the case with screen printing machines of the kind typically used for printing cylindrical plastic containers, in particular, bottles.

In any event the conveyor of such a printing machine causes the articles to be displaced in vertical alignment with the various work stations and the articles pass successively through each of the work stations, successively picked up and dropped off by a mandrel transfer unit provided at each such station.

The transfer units must be controlled synchronously with the advance of the conveyor. Usually the various transfer means are controlled individually by means of a particular piston-and-cylinder means. Thus there must be as many piston-and-cylinder means as there are transfer units as well as means associated therewith such as electrically controlled valves. Accordingly, such arrangements are therefore relatively expensive.

On the other hand, centrally mechanically controlling the various transfer units has been proposed by running them off a central control shaft suitably rotatably driven synchronously with the conveyor. Yet, with such known arrangements the control of each of the transfer units is effected through a separate cam fixed for rotation with the central control shaft. Consequently, there are as many cams as there are transfer units to be controlled and this arrangement is therefore also relatively expensive.

According to a general object of the invention there is provided a more economical centrally mechanically controlled printing machine.

According to the invention there is provided a centrally mechanically controlled printing machine comprising a conveyor equipped with spaced apart article carriers adapted to accommodate articles to be printed. A plurality of work stations are spaced longitudinally along the conveyor, each of the work stations being equipped with a mandrel transfer unit adapted to selectively pick up an article from an article carrier and drop off the article. A cam synchronously controls the operation of the mandrel transfer units with the advance of the conveyor. The improvement comprises a single cam for at least two of the work stations, a cam follower cooperable with the single cam being carried on an arm fixed for rotation with a central control shaft common to said two work stations, and an actuating lever controlling each of the mandrel transfer units being fixed for rotation with the central control shaft.

As the number of cams may be reduced a substantial economy may be realized.

Preferably, there is a single cam and a single control shaft for all the work stations.

Preferably, the actuating lever for one of the work stations comprises the arm carrying the cam follower. Additional economy is thus realized by this arrangement, a single member having a dual function, namely, that of the drive arm for the central control shaft and that of the actuating lever for one of the mandrel transfer units.

These and other features and advantages of the invention will be brought in the description which follows, given by way of example, with reference to the accompanying diagrammatical drawings.

Figure 1:
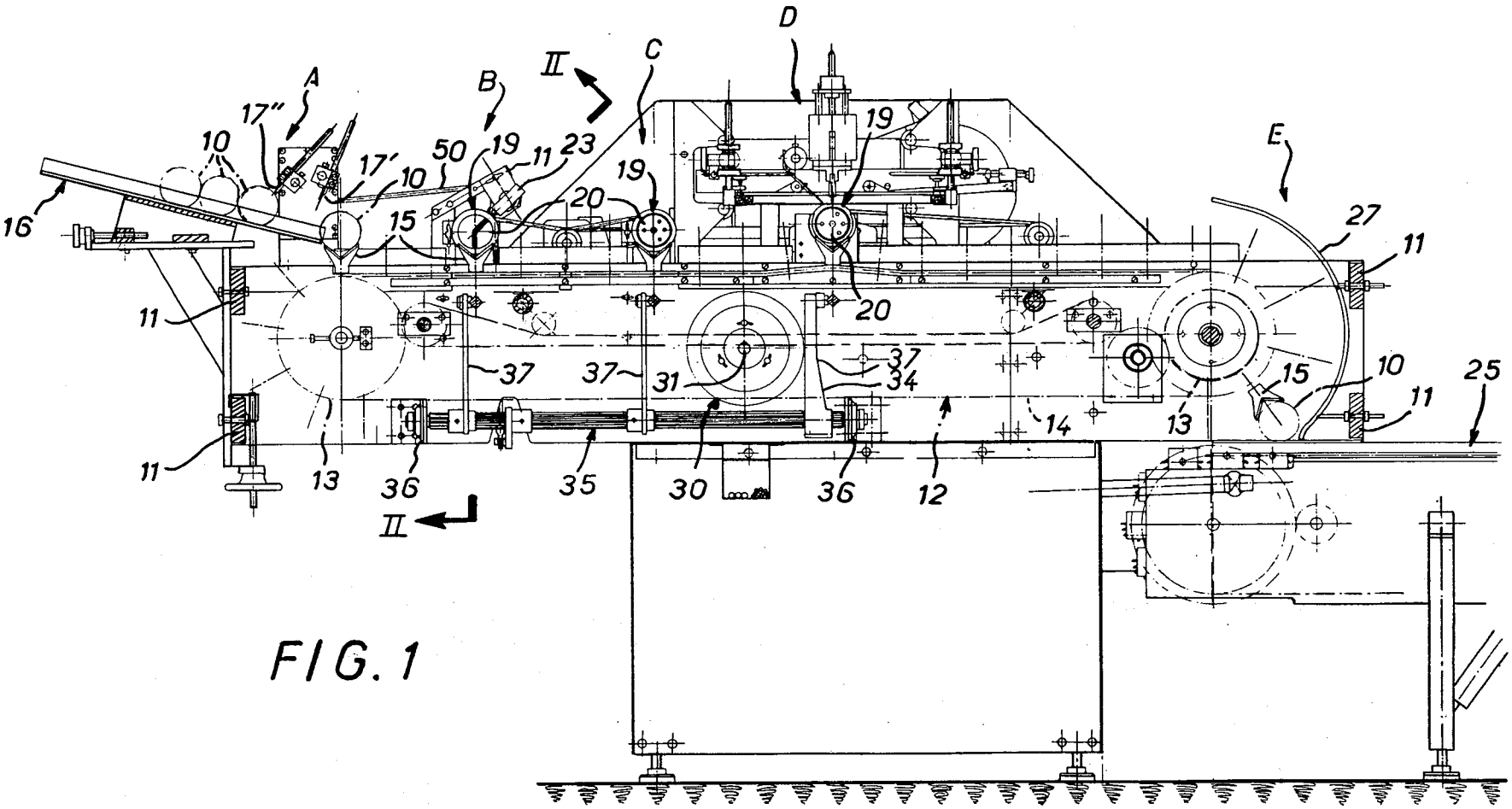
FIG. 1 is a side elevational view in section of a printing machine embodying the invention, some of the forward housing being removed for the sake of clarity.

As shown in the drawings, the printing machine embodying the invention which is intended for printing images on cylindrical containers or bottles 10 comprises a fixed frame or housing all of whose various parts are designated by the same numeral 11, a conveyor 12, and a plurality of work stations mounted on the frame 11 spaced along the conveyor 12 comprising a feed station A, a flame treatment station B, a prepositioning station C, a printing station D, and a discharge station E.

Of a generally conventional construction the printing machine as a whole will not be considered in detail herein. Only those parts necessary for the understanding of the invention are described hereinbelow.

As diagrammatically illustrated the conveyor 12 may be a chain conveyor, i.e., a conveyor comprising two parallel endless chains 14 each running over a pair of sprockets 13 one of which is a drive sprocket and one is preferably transversely adjustably mounted relative to the other. Such a conveyor 12 may have an intermittent advance controlled by a Geneva wheel which is rotated by a motor associated with a speed reducing gear.

However it may be, the conveyor 12 is equipped with spaced-apart article carriers 15 adapted to accommodate articles to be printed. As shown, the articles carriers 15 comprise pairs of opposed angle members or dihedrons for locally supporting a container 10 in recumbent position at the ends of its body.

In the illustrated embodiment the feed station A comprises an inclined plane or table 16 on which bottles 10 to be printed are orderly arranged, for example with their necks extending forwardly in the same direction, the bottles rolling down the plane merely by the force of gravity. At the lower or downstream end of the inclined plane are provided a pair of selective release members 17' and 17'' spaced from each other whose operation will be described in greater detail hereinbelow. The release members 17', 17'' are adapted to release the bottles 10 to be printed one at a time, permitting them to be received and accommodated in a corresponding article carrier 15 as they reach the same.

Each of the work stations B, C and D, namely the flame treatment station, the prepositioning station, and the printing station, is equipped with a mandrel transfer unit 19 described in greater detail below with reference to FIG. 2, adapted to selectively pick up a bottle 10 from an article carrier 15 and release or drop off the same after the particular operation carried out at the station.

Figure 2:
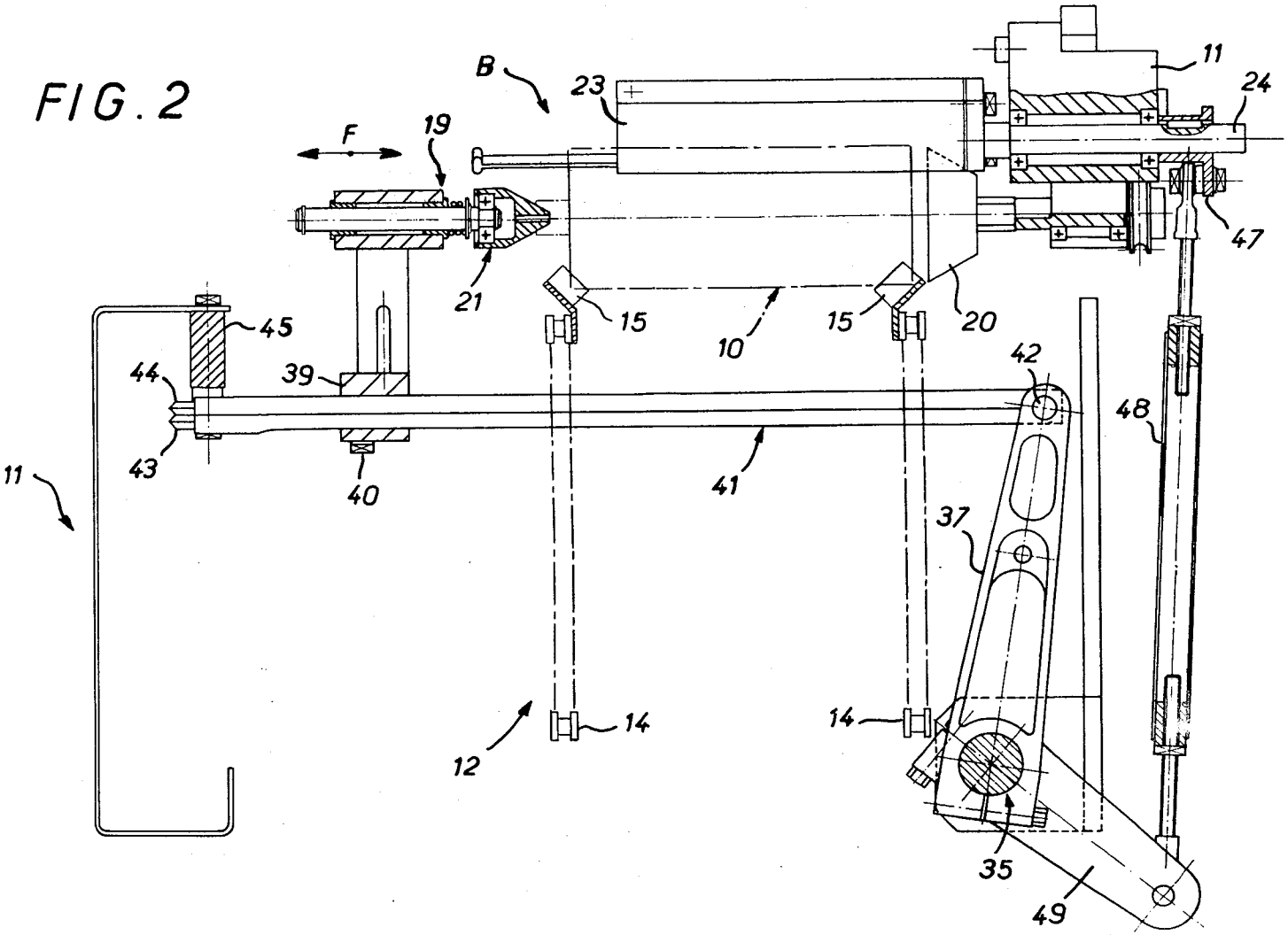
FIG. 2 is, on a larger scale, a cross-sectional view taken on broken line II—II in FIG. 1 for illustrating a mandrel transfer means with a simplified showing of the conveyor, various parts being removed for the sake of clarity.

Generally speaking, such a mandrel transfer unit comprises, to this end, on transversely opposed sides of the conveyor 12 facing each other, a cup member 20 adapted to be rotated and, as shown, fixed relative to the conveyor 12, and a mandrel 21 which is transversely movable with respect to the cup member 20 as represented by the double-headed arrow F in FIG. 2. As the mandrel 21 moves toward the associated cup member it comes into engagement with the neck of the bottle 10 which is in registration with it, and pushes it, causing it to rise along the opposite angle member of the corresponding article carrier 15 until the bottom of the bottle abuts against the cup member 20.

By moving away from the cup member 20 the mandrel 21 frees the bottle 10 and merely by gravity it falls to the angle member 15 of the corresponding article carrier 15 below, the bottle being held in position by the transfer unit during a dwell period of the article carrier 15.

At the flame treatment station B is provided, transversely, a burner 23 carried by a pivot 24 for swivelly mounting the burner 23 as described in detail hereinbelow. Such a burner 23 provides a surface treatment of the bottle to be printed before it is printed.

At the prepositioning station C the corresponding backup member 20 is rotated to the desired angular position of the bottle 10 held between the corresponding mandrel 21 and the backup member 20.

At the printing station the bottle 10 held between the backup member 20 and the mandrel 21 of the corresponding transfer unit is printed, for example, by a seriographic or screen method.

At the discharge station E the conveyor 12 is relieved of printed bottles carried thereon. As shown, for example, the conveyor 12 discharges its bottles onto a subjacent discharge conveyor 25, the bottles being maintained in position on the conveyor 12 in the interim by curved guides 27 (FIG. 1).

In the illustrated embodiment a drying station is provided. The discharge conveyor 25 is, for example, provided with baskets which pass through a dryer or oven for drying the printed bottles. Also, if desired, the corresponding transfer means 19, represented in phantom lines in FIG. 3, at the ultraviolet drying station D' may be provided between the printing station D and the discharge station E.

For movement of its mandrel 21 each transfer unit 19 is controlled by a control cam synchronously controlled with the conveyor 12 which is operated by the same motor and speed reducing gear as the conveyor.

According to the invention, a single control cam 30 is provided for at least two of the work stations B, C and D. In practice, as illustrated in the embodiment represented, a single control cam 30 is provided for all of the work stations B, C and D and, as will be described in greater detail below, the feed station A.

Figure 3:
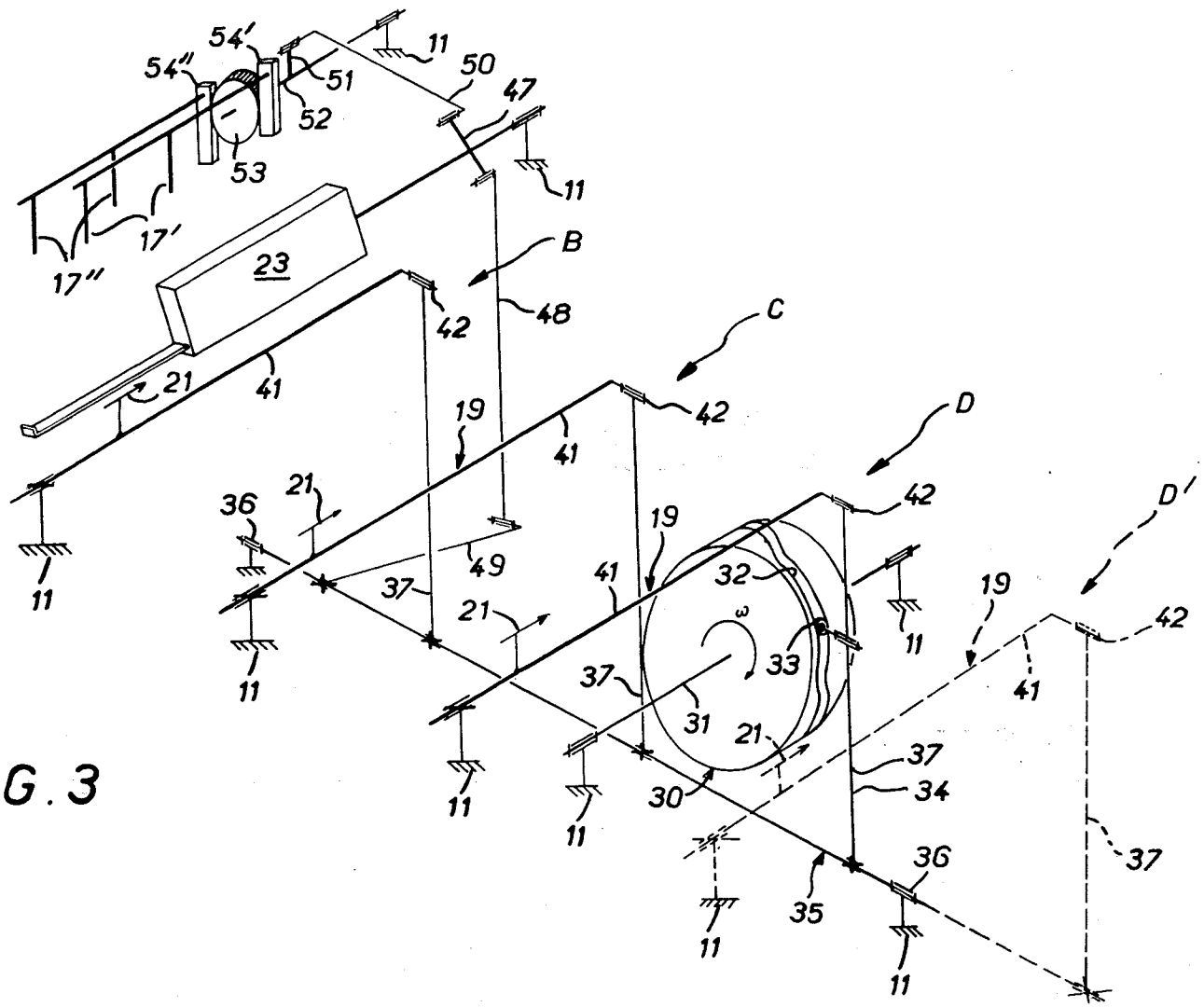
FIG. 3 is a schematic perspective view illustrating the kinematics of the centrally mechanically controlled printing machine embodying the invention.

The control cam 30 is mounted for rotation on a spindle 31. There is a double camway 32 formed at the edge of the cam in engagement with a follower 33. The follower 33 is carried on an arm fixed for rotation with a central control shaft 35 common to all the work stations B, C and D (FIGS. 1–3).

To reduce weight the central control shaft 35, which is rotatably mounted in bearings at its ends, is preferably hollow.

The mandrel 21 of each of the transfer units 19 is operated by an actuating lever 37 fixed for rotation on the central control shaft 35. In actual practice the arm 34 itself comprises an actuating lever 37 for the mandrel 21 of the transfer unit 19 at the printing station D.

Also in practice, each mandrel 21 is carried by a support block 39 adjustably secured in position by a set screw 40 on a bar 41. One end of the bar 41 is pivotally connected by a pivot pin 42 to the corresponding actuating lever 37 and the other end of the bar is slidably and rotatably mounted in a guide 43 (FIG. 2).

In the illustrated embodiment the bar 41 has a square section and the corresponding guide 43 comprises two V-rollers 44 disposed respectively on either side of the bar 41 and mounted on a common support block 45 fixed on the frame 11 of the machine. The mere engagement of the roller 44 with the bar 41 is sufficient to permit swivel movement caused by the pivoting of corresponding actuating lever 37 as these swivel movements are of small amplitude.

As will be readily understood, in the course of rotation of the control cam 30 which is synchronously with the intermittent advance of the conveyor 12, the arm 34 controlled by this cam 30 causes alternating rotation of the central control shaft 35 and thereby the pivoting of the various actuating levers 37 and therefore a selective control of the various mandrels 21 with the particular operations, described above, at the corresponding work stations.

Preferably, the swinging of the burner 23 at the flame treatment station B necessary for lifting the burner 23 in the course of the stepwise advance of the conveyor 12 and thereby avoiding that its flame is operative outside periods of rotation of the bottle 10 to be printed, is ensured by the central control shaft 35. To this end, in the illustrated embodiment (FIG. 2) the spindle 24 carrying the burner 23 is fixed for rotation with an eccentric 47 which is connected to a crank 49 by a control rod 48 which is preferably adjustably in length, the crank 49 being fixed for rotation with the central control shaft 35.

Preferably, the selective operation of the release members 17, 17'' at the feed station A, the release members 17' being necessary for releasing the leading bottle at the downstream end of the station and the release member 17'' for releasing the following bottles, is ensured by the central control shaft.

To this end, in the embodiment illustrated (FIGS. 1 and 3) a crank 50 attached to the eccentric 47 of the burner 23 is also attached to another eccentric 51 controlling the release members 17', 17''. As illustrated on the pivot pin 52 for the eccentric 51 is fixed for rotation a gear 53 which meshes with two parallel racks 54', 54'' carrying the release members 17', 17'' (FIG. 3). As shown in FIG. 1 the release fingers are angularly adjustable on the racks 54', 54'' for adapting the machine to different diameter bottles.

In any event, it follows from the foregoing that under the control of a single control cam 30 the central control shaft 35 ensures not only the control of all the transfer units 19 of the printing machine embodying the invention at the different work stations, but also the control of the burner at the flame treatment station B and the release fingers 17', 17'' at the feed station A, the combination thereby comprising a particularly economical to construct centrally mechanically controlled machine.

Obviously, the invention is not intended to be limited to the illustrated and described embodiment but encompasses all variations and modifications which will be apparent to those skilled in the art without departing from the scope of the appended claims. In particular, the number of work stations affected by the central control shaft does not matter; the central control shaft may be longer or shorter depending on the number of work stations it serves.

Conversely, if the work stations served are spread along too great a length, the central control shaft may be divided into two or more sections, each controlled by a separate control cam operating synchronously with the others, at least one of the central control shaft sections serving at least two separate work stations from a single control cam according to the invention.

Moreover, the field of use of the invention is not limited to that of screen printing machines, but on the contrary includes other types of printing machines.

The nature and operation of the feed station of such a printing machine may be different. The bottles may in fact be fed onto the conveyor by hand. This may likewise be the case at the discharge station.

Finally, if desired, it is possible to control not only the mandrels of the transfer units but also their backup members.

What is claimed is:

1. A centrally mechanically controlled printing machine, comprising a conveyor equipped with spaced-apart article carriers for accommodating articles to be printed, a plurality of work stations disposed along said conveyor, each of said work stations being equipped with a separate mandrel transfer unit for selectively picking up an article from one of said article carriers and dropping said article off, the operation of said mandrel transfer units being synchronously controlled by cam means responsive to the advancement of said conveyor, said cam means being at least a single cam which is provided for at least two of said work stations, a cam follower cooperable with said single cam, a central control shaft common to said two work stations, said cam follower being fixed for rotation with said central control shaft, and an actuating lever for controlling each of said mandrel transfer units being fixed for rotation with said central control shaft.

2. The printing machine of claim 1, wherein said cam follower is carried by an arm fixed for rotation with said central control shaft.

3. The printing machine of claim 1, wherein said cam follower is carried by one of said actuating levers.

4. The printing machine of claim 1, wherein said single cam is associated with all of said work stations.

5. The printing machine of claim 1, wherein each of said mandrel transfer units is carried by a bar, one end of said bar being pivotally connected to said actuating lever associated with said mandrel transfer unit and the other end of said bar being slidably and rockably mounted in a guide.

6. The printing machine of claim 1, wherein said work stations comprise a flame treatment station, a prepositioning station, a printing station and a drying station.

7. The printing machine of claim 1, wherein one of said work stations comprises a flame treatment station including a burner, means swivelly mounting said burner and means connecting said central control shaft to said burner for imparting movement thereto.

8. The printing machine of claim 7, wherein said means swivelly mounting said burner comprises a spindle and said means connecting said central control shaft to said burner comprises an eccentric fixed for rotation with said spindle and a control rod connecting said eccentric to a crank fixed for rotation with said central control shaft.

9. The printing machine of claim 8, wherein one of said work station comprises a feed station including selectively operable release fingers controlled by another eccentric, and another connecting rod connecting said other eccentric to said first mentioned eccentric for controlling the latter.

10. The printing machine of claim 1, wherein one of said work stations comprises a feed station including selectively operable release fingers controlled by said central control shaft.

11. The printing machine of claim 1, wherein said single cam controls said mandrel transfer units of a flame treatment station, a prepositioning station, and a printing station.

12. The printing machine of claim 1, wherein one of said work stations comprises a feed station controlled by said central control shaft.

* * * * *